US007787791B2

(12) United States Patent
Bartley et al.

(10) Patent No.: US 7,787,791 B2
(45) Date of Patent: Aug. 31, 2010

(54) METHOD OF TRACKING THE VIRTUAL LOCATION OF A SHEET OF MEDIA TO IMPROVE FIRST COPY TIME

(75) Inventors: Brian Keith Bartley, Burgin, KY (US); Johnny Ray Sears, Versailles, KY (US)

(73) Assignee: Lexmark International, Inc., Lexington, KY (US)

( * ) Notice: Subject to any disclaimer, the term of this patent is extended or adjusted under 35 U.S.C. 154(b) by 18 days.

(21) Appl. No.: 11/085,895

(22) Filed: Mar. 22, 2005

(65) Prior Publication Data

US 2006/0216052 A1 Sep. 28, 2006

(51) Int. Cl.
*G03G 15/20* (2006.01)

(52) U.S. Cl. ..... 399/70

(58) Field of Classification Search ..... 399/70, 399/68, 69

See application file for complete search history.

(56) References Cited

U.S. PATENT DOCUMENTS

| | | | | |
|---|---|---|---|---|
| 5,325,166 | A | 6/1994 | Hamilton et al. | |
| 5,495,326 | A * | 2/1996 | Mikida | 399/43 |
| 6,118,969 | A | 9/2000 | Curry et al. | |
| 6,160,975 | A | 12/2000 | Bartley et al. | |
| 6,185,389 | B1 | 2/2001 | Bartley et al. | |
| 6,304,731 | B1 | 10/2001 | Able et al. | |
| 6,356,735 | B1 * | 3/2002 | Hozumi | 399/395 |
| 6,466,751 | B1 * | 10/2002 | Kawano | 399/68 |
| 6,799,004 | B2 * | 9/2004 | Richtsmeier | 399/70 |
| 6,801,745 | B1 | 10/2004 | Gogate et al. | |
| 6,822,672 | B1 | 11/2004 | Able et al. | |
| 6,823,150 | B1 | 11/2004 | Cao et al. | |
| 2003/0215271 | A1 * | 11/2003 | Yoshinaga et al. | 399/325 |
| 2004/0190957 | A1 | 9/2004 | Gogate et al. | |
| 2004/0202489 | A1 * | 10/2004 | Kudou et al. | 399/66 |
| 2004/0218942 | A1 | 11/2004 | Gogate et al. | |

FOREIGN PATENT DOCUMENTS

| | | | |
|---|---|---|---|
| JP | 08095425 A | * | 4/1996 |
| JP | 08-152834 | | 6/1996 |
| JP | 08152834 A | * | 6/1996 |
| JP | 2001117417 A | * | 4/2001 |
| JP | 2004252295 A | * | 9/2004 |

* cited by examiner

*Primary Examiner*—Quana M Grainger

(57) ABSTRACT

The present invention relates to printers and media fixing mechanisms such as fusers and management of fuser performance. An article, device, method, and system are provided in which the time to the fuser nip of a sheet of media may be calculated and may be compared to the fuser ramp time. When the fuser ramp time exceeds the time for the sheet of media to reach the fuser nip, the fuser may be turned on.

12 Claims, 5 Drawing Sheets

METHOD OF TRACKING THE VIRTUAL LOCATION OF A SHEET OF MEDIA TO IMPROVE FIRST COPY TIME

FIELD OF INVENTION

The present invention relates to printers and media fixing mechanisms such as fusers and management of fuser performance.

BACKGROUND

Generally, in electrophotographic printing, unfused toner particles may be electrostatically attracted to media to form an image. In order for the image to be fixed permanently, the toner particles may be fused to the media. Fusing may occur when heat and pressure are applied to the toner particles, which may cause the particles to melt and adhere to the print media. To apply heat and pressure, a fuser may be used, in combination with a backup roller or other device, to apply heat and pressure.

In printing, particularly when using an electrophotographic printer, it may be undesirable to heat the media fixing device (e.g. fuser) at printing temperature while there is no media in the nip between the fuser and the backup roller as this may transfer excess energy to the backup roller. Excess energy in the backup roller may cause various complications which may include temperature offset defects or papers stalls resulting from the generation of steam when moisture is boiled out of the media too quickly. However, it may be desirable to have the fuser at or near printing temperature when the leading edge of a sheet of media reaches the nip.

SUMMARY

An exemplary embodiment of the present invention relates to a method for feeding media to a printer containing a media fixing mechanism containing a nip comprising determining an actual feed time (FTa) for media; determining a pick delay (PD) for the media; adding the feed time (FTa) to the pick delay (PD) to obtain a time to a fuser nip (FTf); determining a ramp time (RT) for the fuser to reach a target temperature; and comparing the ramp time (RT) to the time to the fuser nip (FTf).

Another exemplary embodiment of the present invention relates to a system comprising a printing device capable of determining an actual feed time (FTa) for media; determining a pick delay (PD) for the media; adding the feed time (FTa) to the pick delay (PD) to obtain a time to a fuser nip (FTf); determining a ramp time (RT) for the fuser to reach a target temperature; and comparing the ramp time (RT) to the time to the fuser nip (FTf).

Another exemplary embodiment of the present invention relates to an electrophotographic device comprising a control circuit capable of determining an actual feed time (FTa) for media; determining a pick delay (PD) for the media; adding the feed time (FTa) to the pick delay (PD) to obtain a time to a fuser nip (FTf); determining a ramp time (RT) for the fuser to reach a target temperature; and comparing the ramp time (RT) to the time to the fuser nip (FTf).

Another exemplary embodiment of the present invention relates to an article comprising a storage medium having stored thereon instruction that when executed by a machine result in the following operations determining an actual feed time (FTa) for media; determining a pick delay (PD) for the media; adding the feed time (FTa) to the pick delay (PD) to obtain a time to a fuser nip (FTf); determining a ramp time (RT) for the fuser to reach a target temperature; and comparing the ramp time (RT) to the time to the fuser nip (FTf).

DETAILED DESCRIPTION

Figure 1:
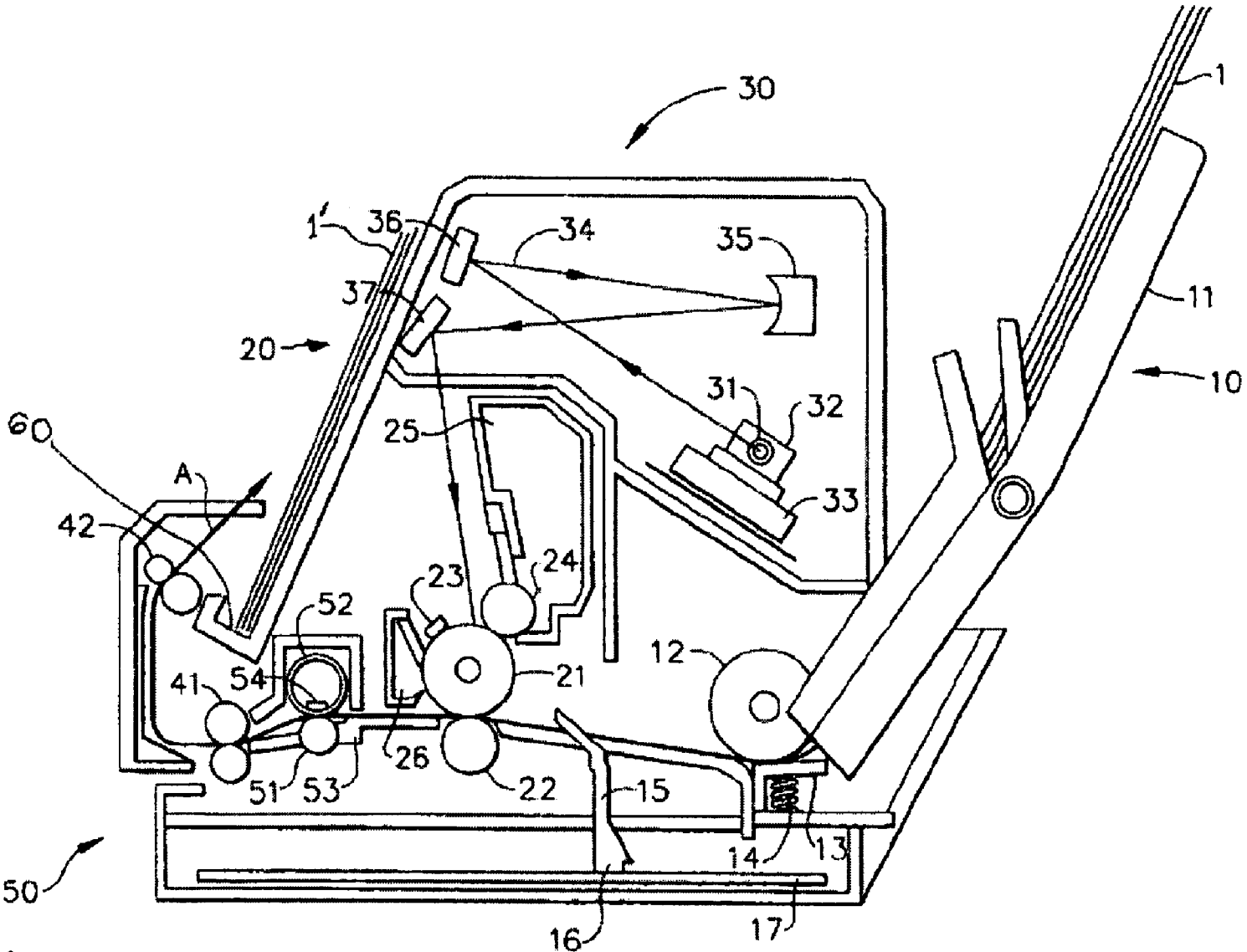
FIG. 1 is a schematic illustration of an embodiment of a portion of an electro-photographic printer contemplated in the present invention.

In electrophotographic printing, e.g., a latent image may be created on the surface of an insulating, photoconducting material by selectively exposing an area of the surface to light. A difference in electrostatic density may be created between the areas on the surface exposed and those not exposed to the light. The latent electrostatic image may be developed into a visible image by electrostatic toners which contain pigment components and thermoplastic components. The electrostatic toner, which may be liquids or powders, may be selectively attracted to the photoconductor's surface, either exposed or unexposed to light, depending on the relative electrostatic charges on the surfaces of the photoconductor, the development electrode and the toner. The photoconductor may be either positively or negatively charged and the toner system similarly may contain negatively or positively charged particles.

A sheet of media, which may include paper, transparencies, envelopes, films, cardstock, or other materials, may be given an electrostatic charge opposite that of the toner and then passed close to the photoconductor's surface. The image may be transferred from the photoconductor onto the sheet of media forming an image on the sheet of media. In order to permanently fix the image onto the media, it may be necessary to fix the toner to the media. Fixing the toner to the media may be accomplished by applying heat and pressure to the toner and media, melting the thermoplastic portion of the toner, causing it to bond to the medium and thereby fixing the image to the media surface.

A fusing system may be used to apply heat to the toner and media. The fuser system may employ two rollers in nip relation through which the media may pass for fusing. One of the two rollers may be a hot-roller or a belt roller. The second of the two rollers may be a backup roller. Heat may be provided by a ceramic or other low thermal capacity heater, or alternatively by a halogen lamp placed inside one or both of the rolls. The heat may be controlled or managed by an open or closed loop control system.

In hot-roller fuser mechanisms, the hot-roller may be a hollow aluminum fuser roller. In belt fuser mechanisms, a polymeric type belt, i.e. a polyimide type belt, or a metal belt may be employed. The belt may be coated with a release coating such as a spray coated or dip coated PTFE, PFA or MFA. Furthermore, a polymeric roller may include filler, such as boron nitride, to enhance the thermal conductivity of the roller.

The backup roller may include a combination of an inner core surrounded by a compliant layer and/or a release layer disposed on the compliant layer. The inner core may be composed of a metal such as aluminum or steel and may provide structural rigidity. Furthermore, the inner core may store thermal energy. The compliant layer may be formed of silicone rubber or another resilient material that may provide compliance to the pressure roller as desired. The release layer may be a PFA sleeve or may be formed of other materials having sufficient release properties.

An embodiment of an electrophotographic printing device may include the laser printer depicted in FIG. 1. The printer may include a media feed section (10), an image-forming device (20), a laser scanning section (30), and fixing device (50). The media feed section (10), may sequentially transport sheets of recording media (or other printing media) (1) to the image-forming device (20) provided in the printer. The image forming device (20) may transfer a toner image to the transported sheet of recording media (1). The fixing device (50) may fix toner to the sheet of recording media (1) sent from the image forming device (20). Thereafter, the sheet of recording media (1) may be ejected out of the printer by media transport rollers (41, 42) and into the output bin (60), shown as 1'. In short, the sheet of media (1) may move along the path denoted by the arrow (A) in FIG. 1. The media feed section (1) may include a feed tray (11), a feed roller (12), a media separating friction plate (13), a pressure spring (14), a media detection actuator (15), a media detection sensor (16), and a control circuit (17).

Upon receiving a print instruction, the sheets of recording media (1) which have been placed in the media feed tray (11) may be fed one-by-one into the printer by operation of the printer feed roller (12), the media separating friction plate (13) and the pressure spring (14). As the fed sheet of media (1) pushes down the media detection actuator (15), the media detection sensor (16) may output an electrical signal instructing commencement of printing the image. The control circuit (17), started by operation of the media detection actuator (15) may transmit an image signal to a laser diode light-emitting unit (31) of the laser scanning section (30) so as to control on/off of the light-emitting diode.

The laser scanning section (30) may include the laser diode light-emitting unit (31), a scanning mirror (32), a scanning mirror motor (33), and reflecting mirrors (35, 36 and 37). The scanning mirror (32) may be rotated at a constant high speed by the scanning mirror motor (33). In other words, laser light (34) may scan in a vertical direction to the media surface of FIG. 1. The laser light (34) radiated by the laser diode light-scanning unit (31) may be reflected by reflecting mirrors (35, 36 and 37) so as to be applied to the photosensitive body (21). When the laser light (34) is applied to the photosensitive body (21), the photosensitive body (21) may be selectively exposed to the laser light (34) in accordance with on/off information from this control circuit (17).

The image-forming device (20) may include the photosensitive body (21), a transfer roller (22), a charging member (23), a developing roller (24), a developing unit (25), and a cleaning unit (26). The surface charge of the photosensitive body (21), charged in advance by the charging member (23) may be selectively discharged by the laser light (34). An electrostatic latent image may thus be formed on the surface of the photosensitive body (21). The electrostatic latent image may be visualized by the developing roller (24), and the developing unit (25). Specifically, the toner supplied from the developing unit (25) may be adhered to the electrostatic latent image on the photosensitive body (21) by the developing roller (24) so as to form the toner image.

Toner used for development may be stored in the developing unit (25). The toner may contain coloring components (such as carbon black for black toner) and thermoplastic components. The toner, charged by being appropriately stirred in the developing unit (25), may adhere to the above-mentioned electrostatic latent image by an interaction of the developing bias voltage applied to the developing roller (24) and an electric field generated by the surface potential of the photosensitive body (21), and may thus conform to the latent image, forming a visual image on the photosensitive body (21). The toner may have a negative charge when it is applied to the latent image, forming the visual image.

Next, the sheet of media (1) transported from the feed section (10) may be transported downstream while being pinched by the photosensitive body (21) and the transfer roller (22). The media (1) may arrive at the transfer nip in timed coordination with the toned image on the photosensitive body (21). As the sheet of media (1) is transported downstream, the toner image formed on the photosensitive body (21) may be electrically attracted and transferred to the sheet of media (1) by an interaction with the electrostatic field generated by the transfer voltage applied to the transfer roller (22). Any toner that still remains on the photosensitive body (21), not having been transferred to the sheet of media (1), may be collected by the cleaning unit (26). Thereafter, the sheet of media (1) may be transported to the fixing device (50). In the fixing device (50), an appropriate temperature and pressure may be applied while the sheet of media (1) is being pinched by moving through the nip formed by a pressure roller (51) and the fixing roller or belt (52) that is maintained at an elevated temperature. The thermoplastic components of the toner may be melted by the fuser belt (52) and fixed to the sheet of media (1) to form a stable image. The sheet of media (1) may then be transported and ejected out of the printer by the printer transport rollers (41, 42) and into the output bin (60) where it may be stacked, one sheet (referenced as 1') of printed media upon another.

The fixing belt (52) may be an endless belt or tube formed from a highly heat resistive and durable material having good parting properties and a thickness of not more than about 100 μm, preferably not more than about 70 μm. Preferred belts may be made from a polyimide film. The belt may have an outer coating of, for example, a fluororesin or Teflon® material to optimize release properties of the fixed toner from the belt. Such fuser belts are well-known in the art. A heater (54), generally a ceramic heater, may be placed on the inside surface of the belt and the outside surface of the belt forms a fusing nip (66) with the backup roller (51) at the location of the heater. Put another way, the heater (54) and the backup roller (51) with the fuser belt (52) interposed between them form the nip (66). Each sheet carrying the toner may travel through this nip [i.e., between the fuser belt (52) and the backup roller (51)] and the toner may be fixed on the sheet through the combination of applied heat, the time the page is in the fuser nip, and pressure. The polyimide belt may be thin so that heat is readily transferred from heater (54). The pressure or backup roller (51) may have a thermal mass that is sufficient to store thermal energy received from the heater (54). Typically, the pressure between the fuser belt (52) and the backup roller (51) at the fuser nip (66) may be from about 5 psi to 30 psi. While the fuser belt (52) may be driven itself, often this is not the case. Generally, the backup roller (51) may be rotated and it is the friction between the surface of the backup roller (51), and the printed sheet and ultimately the surface of the fuser belt (52), which causes the fuser belt (52) to rotate.

The backup or pressure roller (51) may be generally cylindrical in shape. It may be made from or coated with a material that has good release and transport properties for the media (1). The backup roller (51) may be sufficiently soft so as to allow it to be rotated against the fuser belt (52) to form a nip (66) through which the printed sheets of media travel. By going through this nip, printed sheets may be placed under pressure and the combined effects of this pressure, the time the sheet is in the nip, and the heat from the fuser belt (52) acts to fix the toner onto the media. A preferred material for use in forming the backup roller (51) may be silicone rubber. The roller typically has an aluminum core with a silicone rubber layer molded or adhesively bonded onto its surface. This roller may also have a fluoropolymer (e.g., Teflon® sleeve or coating). The backup roller may be essentially hollow, having a metallic core, an outer metallic shell surrounding and essentially concentric with the core, and ribs between the core and the outer shell.

In the context of the present invention, it may be undesirable to heat the fuser at printing temperature while there is no media in the fuser nip, as heating the fuser at printing temperature may transfer excess energy into the backup roll. However, it may also be desirable to have the fuser at or near printing temperature prior to or just as the media is entering the nip, particularly for the first sheet.

The present invention contemplates ramping the temperature of the fuser so that the fuser is at or near a desired temperature range as the media approaches the nip. Ramping may be described as the period beginning when the fuser heater is turned on and when the fuser reaches the desired steady state temperature or temperature range. It should be appreciated that a margin of error or tolerance is allowable in controlling the fuser temperature. Accordingly, a reference to the temperature in the current disclosure incorporates the notion that the temperature may not only be simply a specific point but a desired temperature range.

In the present invention, the amount of time necessary for the temperature of the fuser to reach a desired temperature (12) from an initial temperature (14) is referred to as ramp time or $RT_{(n)}$. It should be appreciated that over time, the ramp time may increase or decrease as a function of time, environment or other variables associated with the printing process.

While many methods may be utilized to ramp and reach steady state control of the desired fusing temperature or temperature range (12), closed loop control may be utilized. An exemplary method of closed loop control is disclosed in U.S. Pat. No. 6,160,975, which is incorporated by reference herein. Other methods of closed loop control that may be used in the present invention include control algorithms that compare the actual temperature to the desired output of the system which is used to adjust the input accordingly. Furthermore, temperature control and steady state control may be accomplished using on/off controls or proportional, integral and/or derivative controls.

Upon the initiation of a print job, it may be necessary for the printer to prepare the various subsystems (print head, transport motor, etc.) for printing. The printer may be idle when the print job is initiated or it may be performing another print job having different settings. Software in the printer may calculate how long it will take each system to be ready and compares these values. The largest of these values may represent the amount of time necessary to perform these functions before the first sheet of media should be picked and fed by the printer, called the pick delay time or PD.

After initialization, a pick delay may be desirable to also maintain a gap between the individual sheets of media, sheet (n), sheet(n+1), etc. It should be understood that reference is made to the sheets of media passing through the device as sheet(n), sheet(n+1), etc. Thus, each of the n, n+1, . . . , etc. will increase by one in the examples described herein for each of the sheets being fed thereafter.

The amount of time necessary for a sheet of media (16), and in particular the leading edge of a sheet of media, to reach the nip rollers after the sheet has been picked is the actual feed time, or FTa. Once a sheet is picked, the printer may assign an actual media path location to the sheet of media, which is the location of a sheet of media within the printer. The media path location for each sheet of media is referenced from a common location in the printer, such as, for example, the media detection actuator (see 15 illustrated in FIG. 1.) To determine the media path location, the distance (D), along the media path, is calculated with respect to time (t) assuming a constant velocity (V) and is illustrated by the following relationship:

$$V = \frac{D}{t}$$

The distance to travel is known, as it is the distance from the media tray or feed roller to the nip rollers. The velocity may be calculated, for example, from the speed of the feed rollers. At a desired increment of time the device software updates the location of each sheet of media within the media path. The desired increment of time may be a microprocessor pulse, or heartbeat, or a predetermined increment of time between 0.001 to 0.100 seconds and all increments therebetween, such as 0.010, 0.019, 0.034, etc. Therefore, the actual feed time, may be updated with each time increment as the velocity and distance travel may be known.

Figure 2:
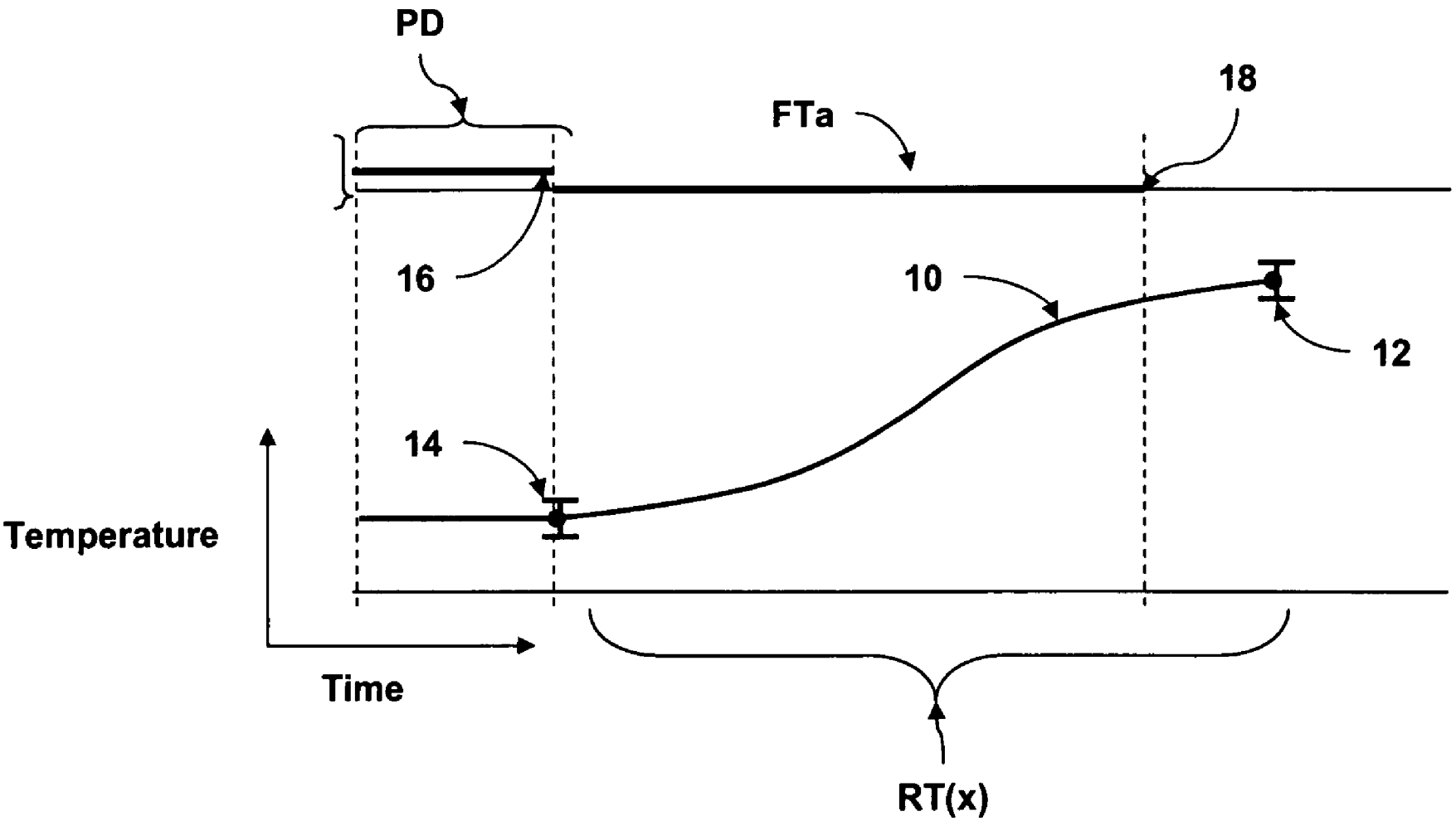
FIG. 2 is a flow chart illustrating initiation of ramp time after pick delay.

FIG. 2 illustrates the situation where, after the pick delay, PD, sheet (16) is picked and the actual feed time FTa is determined. The ramp time, $RT_{(n)}$, is then compared with the actual feed time, FTa, and when the ramp time, $RT_{(n)}$, is greater than the actual feed time, FTa, the fuser is turned on, (14) and the temperature begins to ramp, as generally illustrated by curve 10. However, if the ramp time, $RT_{(n)}$, is greater than the actual feed time, FTa, the sheet (16) may reach the nip (18) prior to the fuser reaching a desired temperature (12). To remedy this issue, it became necessary to incorporate the time to ramp to a minimum temperature in the pick delay, which would guarantee that a desired target temperature would be reached just prior to the sheet entering the nip. This then leads to the result that the launch of media is delayed.

In the context of the present invention, the time period of the pick delay may be employed to accommodate ramp time for the fuser. Accordingly, to accommodate ramp times greater than actual feed times, one may calculate a time to the fuser nip, FTf. The initial value of $FTf_{(i)}$ is the amount of time necessary for the leading of edge of sheet(n) to reach the fuser nip FTa plus the PD. This may be represented by the relationship:

$$FTf_{(i)}=FTa+PD.$$

From the $FTf_{(i)}$, a virtual media path location may be determined using the time/distance/velocity relationship described above, which creates a representative distance that a sheet of media must travel if one were to assume that the media travels from the beginning of the pick delay to the end of the actual feed time.

Similar to the actual feed time, feed time to the fuser nip, FTf, may be recalculated at a desired increment of time to determine where a sheet of media may be located along the virtual media path. It should be understood that while, $FTf_{(i)}$ is the initial time interval, $FTf_{(n)}$ represents the feed time to the nip calculated at subsequent intervals of time and takes into account the media path location change over the interval of time.

Generally, the FTf may be compared to the time necessary for the fuser to ramp in temperature to a desired temperature, $RT_{(n)}$, which may be represented by the following relationship:

$$FTf=X+RT_{(n)}$$

X being a variable of time which changes as the media moves down the media path. Therefore for $FTf_{(i)}$, the following relationship may be considered:

$$FTf(i)=FTa+PD=X+RT_{(n)}$$

After the feed time to fuser nip has been calculated, it may be compared to fuser ramp time. If the ramp time, $RT_{(n)}$ becomes greater than or equal to the time to fuser nip, FTf, when $RT_{(n)} \geqq FTf$, a signal is generated and sent to the fuser to begin ramping to a desired temperature. Therefore, the result is that the fuser may begin ramping prior to the sheet of media actually being picked, and during the pick delay. Hence, if it takes longer for the fuser to ramp than the actual feed time, the fuser may begin to ramp prior to the sheet being picked by taking advantage of the feed time to fuser nip calculation noted above.

Figure 3:
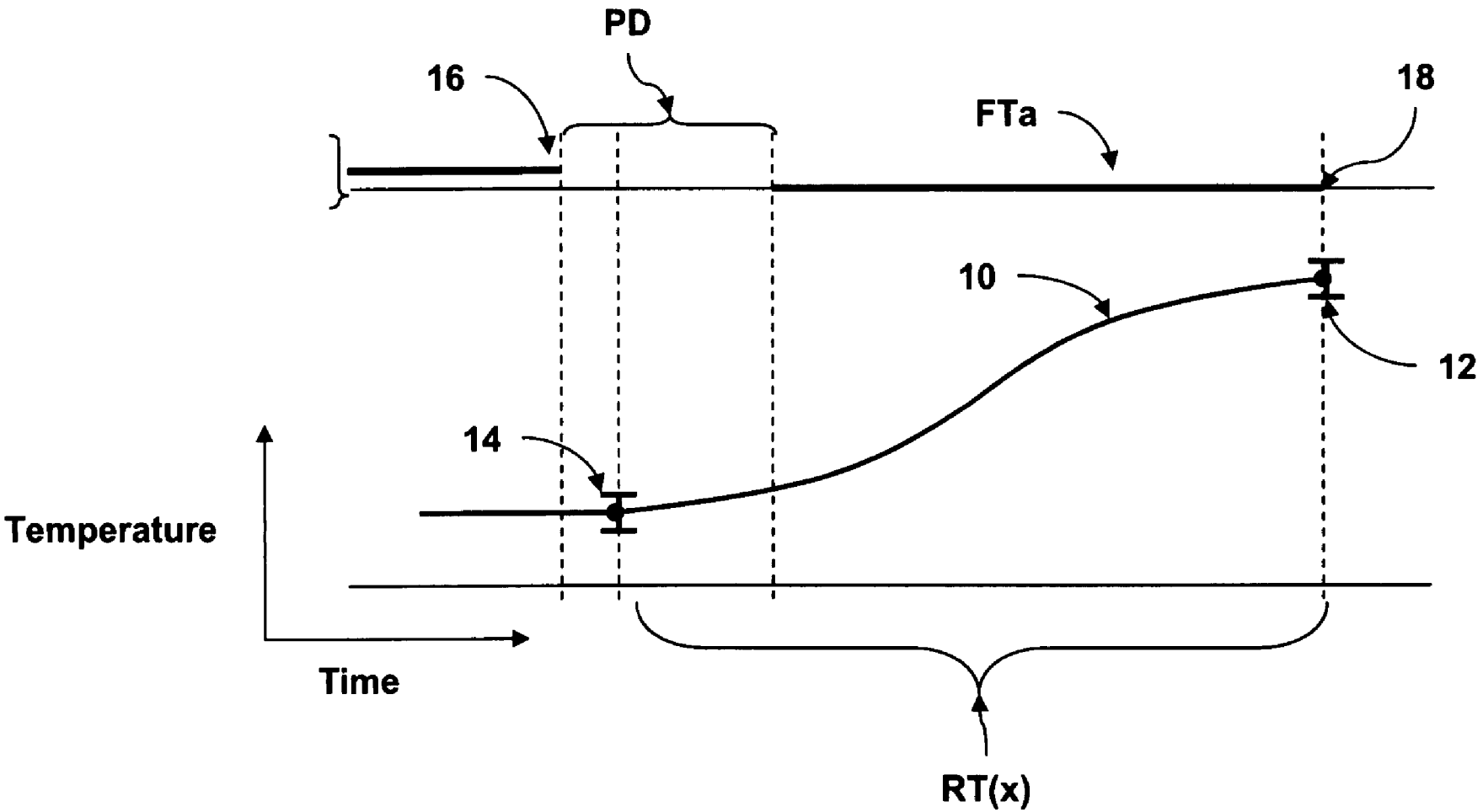
FIG. 3 is a flow chart illustrating initiation of ramp time during pick delay.

Turning to FIG. 3, which illustrates an exemplary embodiment of the present invention with respect to time and temperature, the virtual media path location obtained from the feed time to fuser nip, $FTf_{(i)}$, (16) may serve as a reference for which the ramp time $RT_{(n)}$ may be compared. As time progresses, the feed time to the fuser nip $FTf_{(n)}$ is updated and the media is considered to move along the media path. When the media has reached a location in which the ramp time, $RT_{(n)}$, is greater than or equal to the feed time to the fuser nip, $FTf_{(n)}$, a signal may be sent to turn the fuser on and the temperature ramp may begin at 14. Accordingly, the desired temperature (12) should be met when the media approaches the fuser nip. Thus the printer herein is able to calculate a virtual media path location for the media prior to the media actually being picked.

In an exemplary embodiment, this may result in the reduction of the printing time for the first sheet of media. In the case of a first sheet of media, where a pick delay may occur upon the initiation of a print job, the fuser may begin to ramp during the pick delay using the above stated relationships. Accordingly, by employing a virtual media path location obtained from the feed time to fuser nip, ramping of the fuser may begin prior to the end of the pick delay and the fuser may reach a desired temperature before the media reaches the fuser nip.

In another embodiment, it may be necessary to assign a virtual media path location when the subsystems remain running between print jobs, such as when the printer remains in standby mode. In these cases the printer is already running and a pick delay may not be necessary. However, using the above described relationships, a virtual media path may still be calculated to again accommodate fuser ramp time.

Figure 4:
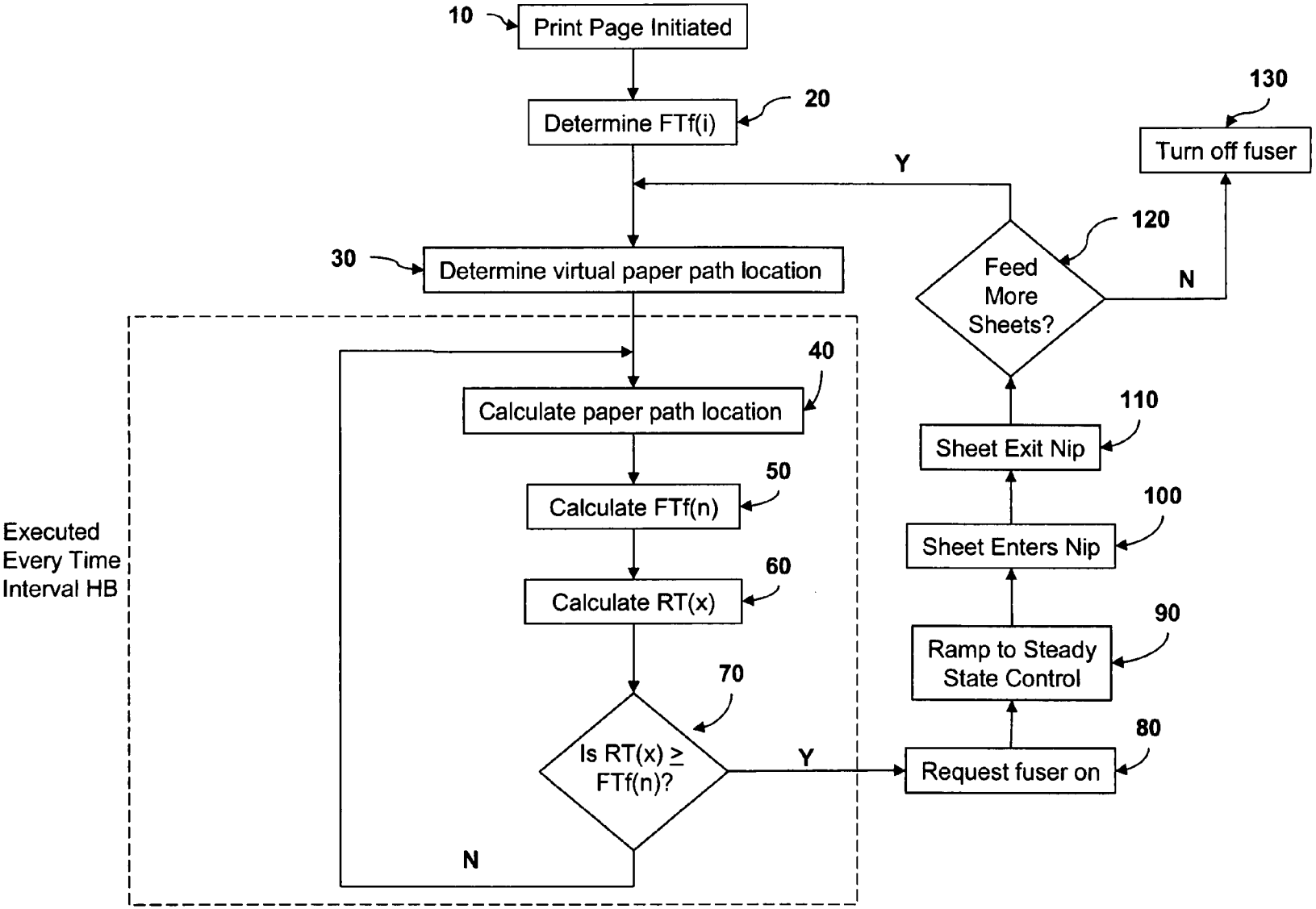
FIG. 4 is a flow chart illustrating an embodiment of the present invention.

Referring now to FIG. 4, a basic flow chart of the process is illustrated. Printing of a sheet of media may be initiated at 10. Upon initiation, the $FTf_{(i)}$ may be determined, (20), and as stated above, this a determination of the pick delay plus the actual feed time of the media. Then a virtual media path location may be assigned to the first sheet of the print job, (30). At every heart beat, HB, or desired time interval, illustrated by the dashed line, the media path may be updated (40), and $FTf_{(n)}$ (50), and $RT_{(n)}$ (60) may also be updated. The $FTf_{(n)}$ may then be compared to $RT_{(n)}$, (70). It should be appreciated that a small factor of error may be added to the $FTf_{(n)}$ to ensure that the ramp time is adequate to reach a target temperature. This error factor may be a predetermined amount of time, such as a heart beat, a specified amount of time or pulse, etc.

When $RT_{(n)}$ is greater than or equal to $FTf_{(n)}$, a signal may be sent to turn the fuser on, (80) which may occur during the pick delay period. After the fuser is turned on (80), the temperature may be ramped to steady state control (90). Steady state control may be accomplished by a number of control mechanisms including, proportional, integral and/or derivative controls. The sheet of media may enter the nip (100) and exit the nip (110). Upon exiting the nip, a determination on whether a subsequent sheet, sheet(n+1), will be fed into the nip after sheet(n), (120). If a subsequent sheet, sheet(n+1), will not be fed into the nip (120), the fuser may then be turned off (130). If a subsequent sheet, sheet(n+1) will be feed into the nip, the process may begin again with a determination of the virtual media path location (30).

If $RT_{(n)}$ is less than $FTf_{(n)}$ (70), then the loop may begin again at the next heart beat calculating the media path location (40).

Although, the discussion herein is mainly with respect to time increments, it should be appreciated that the controlling events may be ones of distance or other associated increments, rather than time (e.g. based on a counting of the feed motor pulses.)

Figure 5:
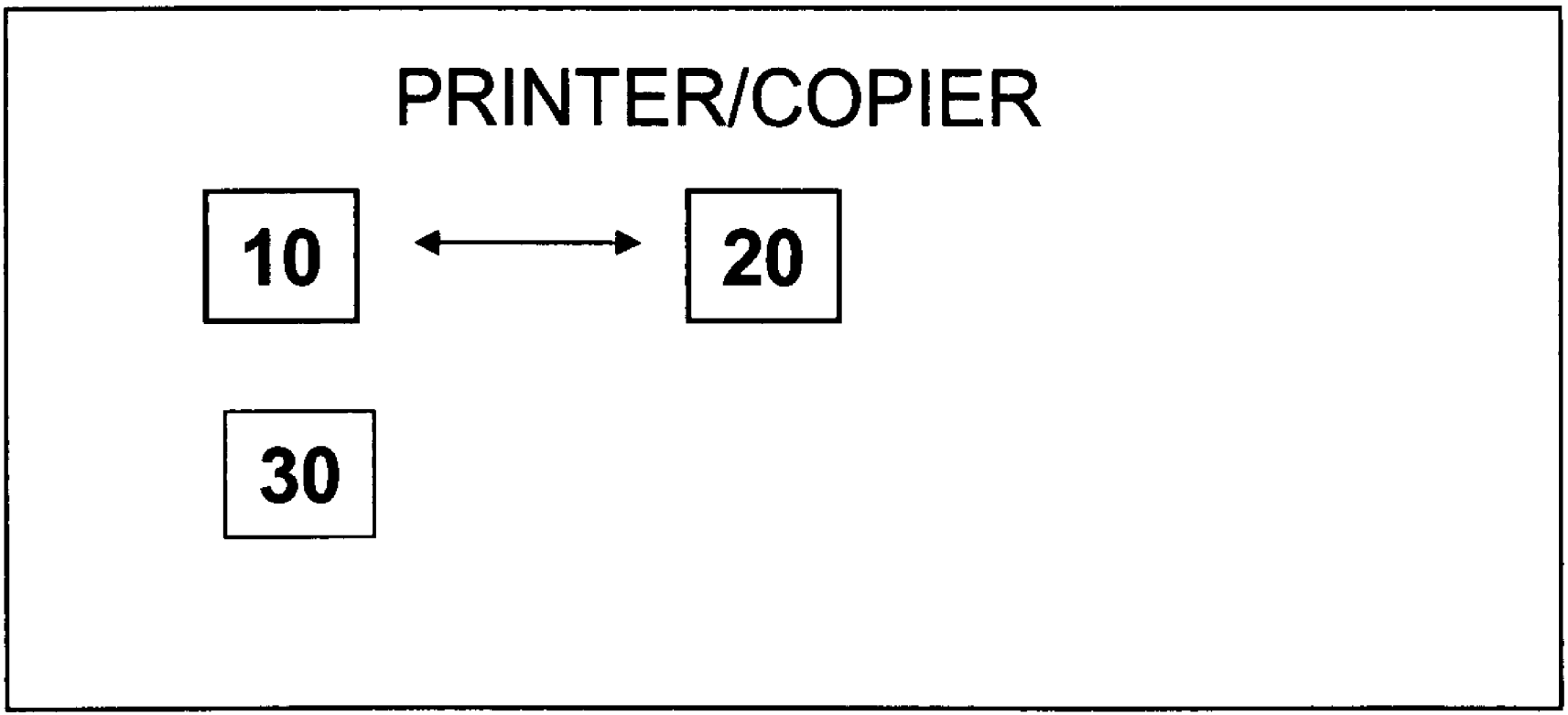
FIG. 5 is an illustration of an embodiment of the present invention relating to an article of machine readable media in relation to a processor and a user interface.

It should also be appreciated that the functionality described herein for the embodiments of the present invention may be implemented by using hardware, software, or a combination of hardware and software, either within the printer or copier or outside the printer copier, as desired. If implemented by software, a processor and a machine readable medium are required. The processor may be of any type of processor capable of providing the speed and functionality required by the embodiments of the invention. Machine-readable memory includes any media capable of storing instructions adapted to be executed by a processor. Some examples of such memory include, but are not limited to, read-only memory (ROM), random-access memory (RAM), programmable ROM (PROM), erasable programmable ROM (EPROM), electronically erasable programmable ROM (EEPROM), dynamic RAM (DRAM), magnetic disk (e.g., floppy disk and hard drive), optical disk (e.g. CD-ROM), and any other device that can store digital information. The instructions may be stored on medium in either a compressed and/or encrypted format. Accordingly, in the broad context of the present invention, and with attention to FIG. 5, the printer or copier may contain a processor (10) and machine readable media (20) and user interface (30).

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed is:

1. A method for feeding media to a printer containing a media fixing mechanism containing a nip comprising:

determining an actual feed time (FTa) for a first sheet of media in a print job to reach said nip;

determining a pick delay (PD) for said media;

adding said feed time (FTa) to said pick delay (PD) to obtain an intial time to a fuser nip ($FTf_{(i)}$) for said first sheet;

determining a ramp time (RT) for said fuser to reach a target temperature;

determining a virtual paper path location of said first sheet from said initial time to a fuser nip ($FTf_{(i)}$) using a time/distance/velocity relationship defined by the following equation:

$$V = \frac{D}{T}$$

wherein V is a velocity based on the speed of a feed roller, D is distance of said first sheet along the virtual paper path in the printer and T is said initial time to said fuser nip ($FTf_{(i)}$);

determining a time to said fuser (FTf) for said first sheet based on said virtual paper path location;

comparing said ramp time (RT) to said time to said fuser nip (FTf); and sending a signal to turn said fuser on if said ramp time (RT) is greater than or equal to said time to said fuser nip (FTf).

2. The method of claim 1, further comprising if said ramp time (RT) is not greater than or equal to said time to said first nip (FTf), following a time increment determining an updated virtual paper path location of said first sheet, determining an updated time to said fuser nip (FTf) of said first sheet based upon said updated virtual paper path location, determining an updated ramp time (RT), comparing said updated ramp time (RT) to said updated time to said fuser nip (FTf) and sending the signal to turn on said fuser if said updated ramp time (RT) is greater than said updated time to said fuser nip (FTf).

3. The method of claim 2, wherein said time increment is selected from the group consisting of pulses or specified time increments.

4. A system comprising:

a printing device capable of determining an actual feed time (FTa) for a first sheet of media in a print job;

determining a pick delay (PD) for said media;

adding said feed time (FTa) to said pick delay (PD) to obtain a time to a fuser nip (FTf);

determining a ramp time (RT) for said fuser to reach a target temperature;

determining a virtual paper path location of said first sheet from said initial time to a fuser nip ($FTf_{(i)}$) using a time/distance/velocity relationship defined by the following equation:

$$V = \frac{D}{T}$$

wherein V is a velocity based on the speed of a feed roller, D is distance of said first sheet along the virtual paper path and T is said initial time to said fuser nip ($FTf_{(i)}$);

determining a time to said fuser (FTf) for said first sheet based on said virtual paper path location;

comparing said ramp time (RT) to said time to said fuser nip (FTf); and sending a signal to turn said fuser on if said ramp time (RT) is greater than said time to said fuser nip (FTf).

5. The system of claim 1, wherein said printing device is further capable of, if said ramp time (RT) is not greater than said time to said fuser nip (FTf), following a time increment determining an updated virtual paper path location of said first sheet, determining an updated time to said fuser nip (FTf) for said first sheet, determining an updated ramp time (RT) comparing said updated ramp time (RT) to said updated time to said fuser nip (FTf) and sending the signal to turn on said fuser nip if said updated ramp time (RT) is greater than said updated time to said fuser nip (FTf).

6. The system of claim 5, further comprising at regular time increments, determining said updated virtual paper path location of said first sheet, said updated ramp time (RT), said updated time to said fuser nip (FTf) and comparing said update ramp time (RT) to said updated time to said fuser nip (FTf) until said updated ramp time (RT) is greater than or equal to said updated time to said fuser nip (FTf) at which point the signal to turn on said fuser nip is sent.

7. An article comprising a storage medium having stored thereon instruction that when executed by a machine result in the following operations:

determining an actual feed time (FTa) for a first sheet of media in a print job;

determining a pick delay (PD) for said media;

adding said feed time (FTa) to said pick delay (PD) to obtain a time to a fuser nip (FTf);

determining a ramp time (RT) for said fuser to reach a target temperature;

determining a virtual paper path location from said initial time to a fuser nip ($FTf_{(i)}$) using a time/distance/velocity relationship defined by the following equation:

$$V = \frac{D}{T}$$

wherein V is a velocity based on the speed of a feed roller, D is distance along a media path in the printer and T is said time to said fuser nip ($FTf_{(i)}$);

determining a time to said fuser (FTf) based on said virtual paper path location;

comparing said ramp time (RT) to said time to said fuser nip (FTf);

sending a signal to turn said fuser on if said ramp time (RT) is greater than or equal to said time to said fuser nip (FTf), wherein the virtual paper path location is determined before picking the media.

8. The article of claim 7, wherein said instructions that when executed by said machine result in the following additional operations:

determining said subsequent time to said fuser nip (FTf) and comparing said ramp time (RT) to said subsequent time to said fuser nip (FTf) at a time increment.

9. The article of claim 8, wherein said time increment is selected from the group consisting of pulses or specified time increments.

10. The method of claim 1, wherein the distance of said first sheet along the virtual paper path is greater than a paper path distance within the printer from a location where said first sheet is picked to said nip of said fixing mechanism.

11. The method of claim 1, wherein said virtual paper path location for said first sheet from said initial time to a fuser nip ($FTf_{(t)}$) is determined if said ramp time (RT) is greater than said actual feed time (FTa).

12. The method of claim 1, wherein said signal to turn on said fuser is sent prior to said first sheet being picked.

* * * * *